United States Patent [19]

Fromme et al.

[11] 4,034,524

[45] July 12, 1977

[54] MOVABLE PARTITION

[75] Inventors: Klaus Fromme; Bernd Walther, both of Oldenburg, Germany

[73] Assignee: Firma Justin Huppe, Oldenburg, Germany

[21] Appl. No.: 603,003

[22] Filed: Aug. 8, 1975

[30] Foreign Application Priority Data

Aug. 14, 1974 Germany ..... 2438982

[51] Int. Cl.[2] ..... E04D 15/00

[52] U.S. Cl. ..... 52/122; 52/143; 52/240; 49/321

[58] Field of Search ..... 52/143, 122, 238, 240; 49/321

[56] References Cited

U.S. PATENT DOCUMENTS

| | | | |
|---|---|---|---|
| 2,886,147 | 5/1959 | Chasteney et al. | 52/122 |
| 2,962,132 | 11/1960 | Reinhardt | 52/143 |
| 3,335,532 | 8/1967 | Greenbie | 52/143 |
| 3,400,504 | 9/1968 | Neisewander | 52/122 |
| 3,453,790 | 7/1969 | Harris | 52/143 |

*Primary Examiner*—Price C. Faw, Jr.
*Assistant Examiner*—Carl D. Friedman
*Attorney, Agent, or Firm*—Olson, Trexler, Wolters, Bushnell & Fosse, Ltd.

[57] ABSTRACT

A movable wall partition is provided on the bottom edge thereof with a caster for rolling the movable wall partition into position. The wall partition is provided at its lower edge with a bracing step which is urged by a jack mechanism into engagement with the floor to lift the caster from the floor and to raise the top edge of the wall partition into engagement with the ceiling.

8 Claims, 7 Drawing Figures

MOVABLE PARTITION

The invention concerns a movable partition of at least one room-high, two-sheet wall element with a horizontal pressure strip extending over the entire width of the element and extendable in a vertical direction by means of an operation device and which, in the extended position, braces the wall element between floor and ceiling of the room, and with at least one floor-end caster which comes out when the pressure strip is retracted, for transporting the wall element in the unextended state.

Partitions of room-high wall elements are usually so constructed that the wall elements hang on rollers which run in ceiling rails when relatively frequent and rapid shifting of the wall elements is desired. However even lighter two-sheet wall elements of the type described above have become familiar, which are placed in any desired location in a room of suitable height without rails, set up vertically and braced between floor and ceiling with the aid of a horizontal pressure strip attached to the upper side of the element. Because of considerable weight of such a wall element, even in a light version, the suggestion has also been made that a swing-out caster be fitted to the underside of the element in such a way that in the transporting of the element it projects below the rigid bottom strip and takes the weight of the element.

The extension of the caster in this well-known wall element is, however, a very laborious step that is not without danger, because, on account of the necessity of raising the partition element—which then, of course is to rest on the swung-out caster—it can be taken only after the ceiling pressure strip has been retracted, hence when the posture of the partition element is a very unstable one. There is thus the danger that when the caster is swung out the partition element may tip over and be damaged.

The decrease or even elimination of this danger is the main problem underlying the invention.

It is solved, according to the invention, by the fact that the pressure strip is fastened continuously and rigidly to the wall element in such a way that the pressure strip upon extension lifts the wall element into its braced position and the caster at the same time leaves the floor.

In this way the engagement and release of the caster is always an automatic result of the bracing and releasing of the partition element and it does not require additional and potentially dangerous work.

Since the instability of the wall element supported on only one caster can also become disturbingly noticeable in the transportation of the element between the storage place and the place where it is to be set up, there is provided in a preferred development of the invention a detachable roller-carrier which can be attached transverse to the element and which has on its free ends casters with axles coplanar to the axle of the caster rigidly attached to the element, meaning that the rolling plane common to all casters is essentially parallel to the bottom of the element. Because the element in the braced position is raised, the carrier can be fitted to it while it is still in the assembled condition and is thus secure. If then the pressure strip attached to the bottom in accordance with the invention is retracted, the casters on the carrier and the caster on the element come more or less simultaneously into position on the floor and catch the element, resulting in a stable triangular support due to the transverse posture of the carrier.

If the casters on the carrier can pivot around vertical axes, the unbraced wall element can be especially easily moved about. For the rapid manipulation of the carrier it is an advantage to have a vertical spar attached to the middle of the carrier for fastening it to a face of the element.

Insofar as the two-sheet element construction consists of a frame and cover panels attached to both sides of it, the element caster is preferably attached to the bottom frame cross spar. This leads to an especially stable structure of the element.

A further development of this wall element design provides that in the braced state the cover panels enclose a strip fastened to the room ceiling. Of course in this case the erection of the element is again bound to the location of the ceiling strip, but this disadvantage in many cases is made up for by achieving in a simple manner a singularly effective elimination of sound passages and above all at the same time avoiding any pressure on the—for example merely hung—ceiling.

The drawing illustrates the invention with the example of one execution:

Figure 1:
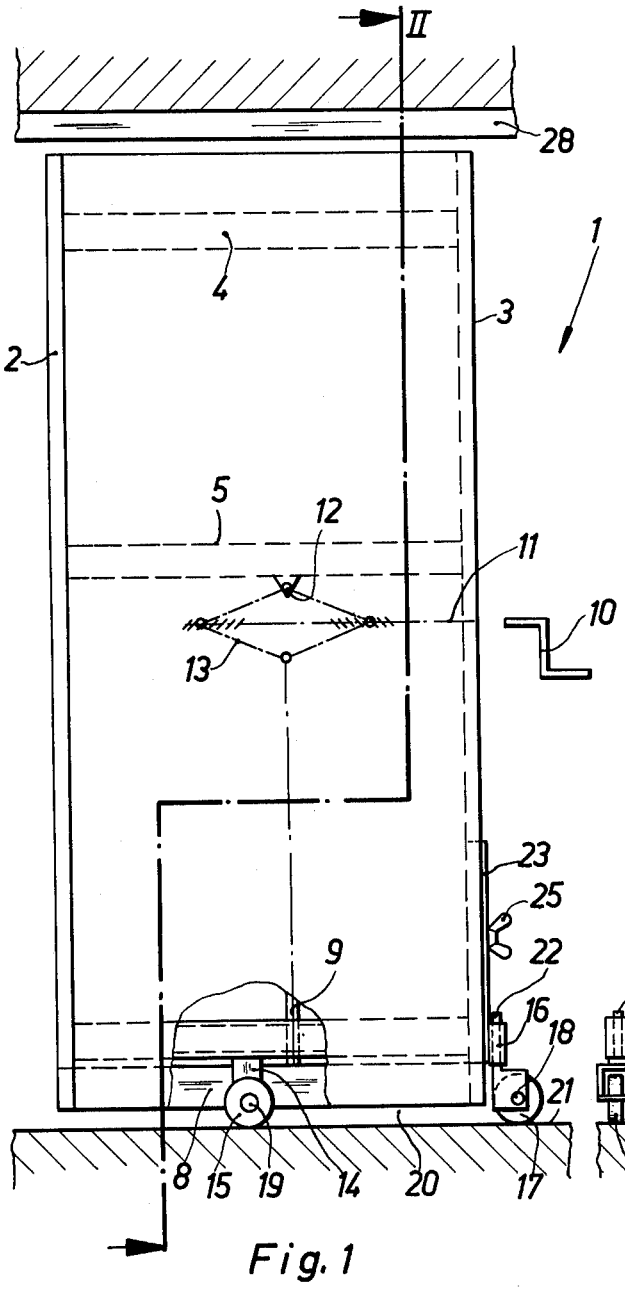
FIG. 1 is a partially broken side view of a partition according to the invention before bracing, but already in the erection location.

The whole wall element designated by 1 consists of a frame formed by the side studs 2 and 3, the top cross spar 4, the middle cross spar 5 and the bottom cross spar 6, as well as the cover panels attached on both sides; the method of attachment is not shown, but can be any suitable or known means including adhesives, nails, screws, etc. On the bottom there is located between the cover panels 7 and underneath the bottom cross spar 6 a pressure strip consisting of two parallel pressure bands 8 as well as a common one (not shown). This pressure strip is carried opposite the lower frame cross spar 6, extends horizontally over the whole width of the element 1, and can be moved vertically downward by means of a pushrod 9. A parallelogram type jack 13 mounted on pivot 12 under the middle cross spar 5 is actuated by a threaded rod 11 and a crank handle 10 to raise and lower the pushrod 9.

To the lower frame cross spar 6 there is rigidly attached a downward extending bracket 14 which supports a freely swiveling caster 15, in such a way that it extends between the pressure bands 8 and does not interfere with the vertical movement of the pressure strip. FIG. 1 shows clearly that the caster 15 is not located centrally to the width of the wall element 1, but is at a greater distance from frame stud 3 than from frame stud 2.

Figure 7:
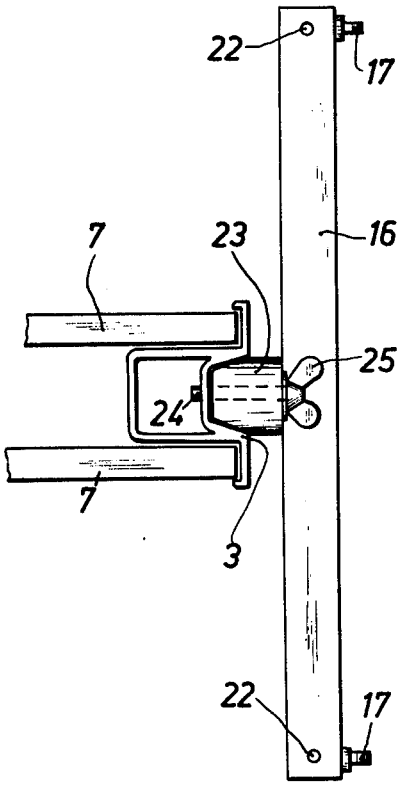
FIG. 7 is a view of the carrier from above in its position attached to a wall element shown in cross-section.

This is related to the fact that frame stud 3, whose front surface in cross section is basically concave or V-shaped (FIG. 7), has a detachable carrier 16 fixed to it which runs transverse to the plane of the wall element 1 and has on its free ends casters whose axles 18 lie essentially in the same plane as the axles 19 of caster 15. The common rolling plane of the casters 15, 17 runs parallel to the underside 20 of the wall element 1 and is formed by the floor in the situation represented in FIGS. 1 and 2. The casters, moreover, swivel around vertical pivots 22 on the carrier.

Figure 5:
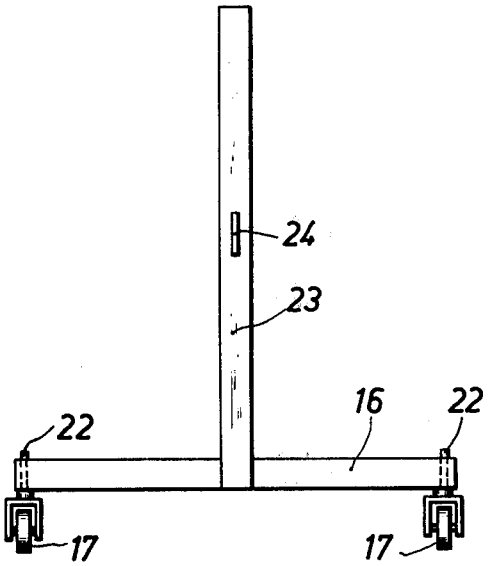
FIG. 5 is a front view of the carrier separated from the wall element.
Figure 6:
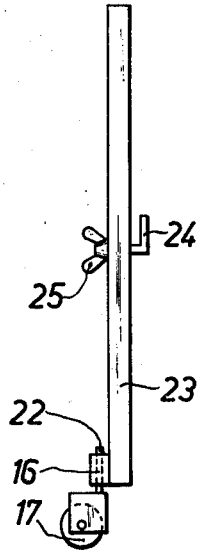
FIG. 6 is a side view of the carrier.

For fastening the carrier 16 to the frame stud 3 there is a vertical spar 23 which is solidly attached to the carrier 16 (FIGS. 5 and 6). As FIG. 7 makes clear, the side of the vertical spar 23 facing the frame stud 3 in the assembled state is correspondingly convex or V-shaped, so that the engagement of a tenterhook 24, which penetrates the spar 23, behind the thickness of the frame stud 3 suffices to bind the vertical spar 23 and with it the carrier 16 solidly in all directions to the wall element 1 when the hook 24 is tightened by means of the wingnut 25.

Figure 2:
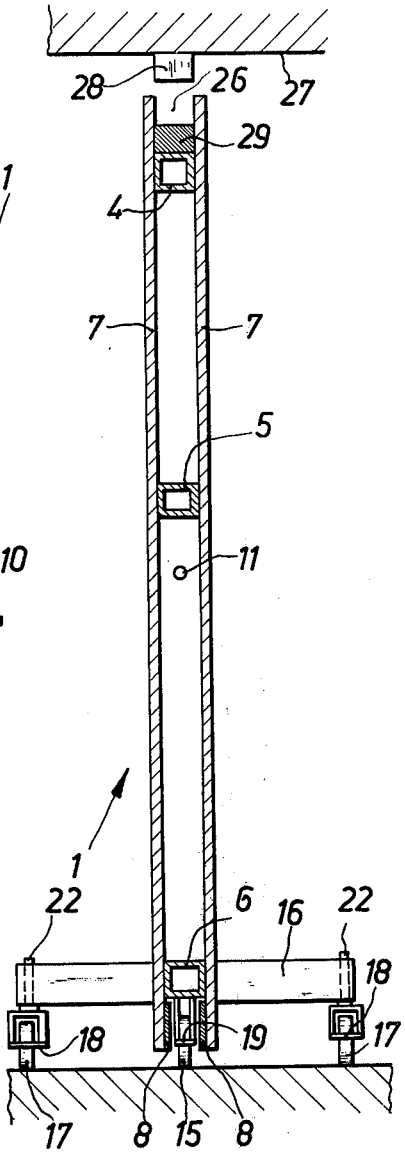
FIG. 2 is a cross-section along line II—II in FIG. 1.
Figure 3:
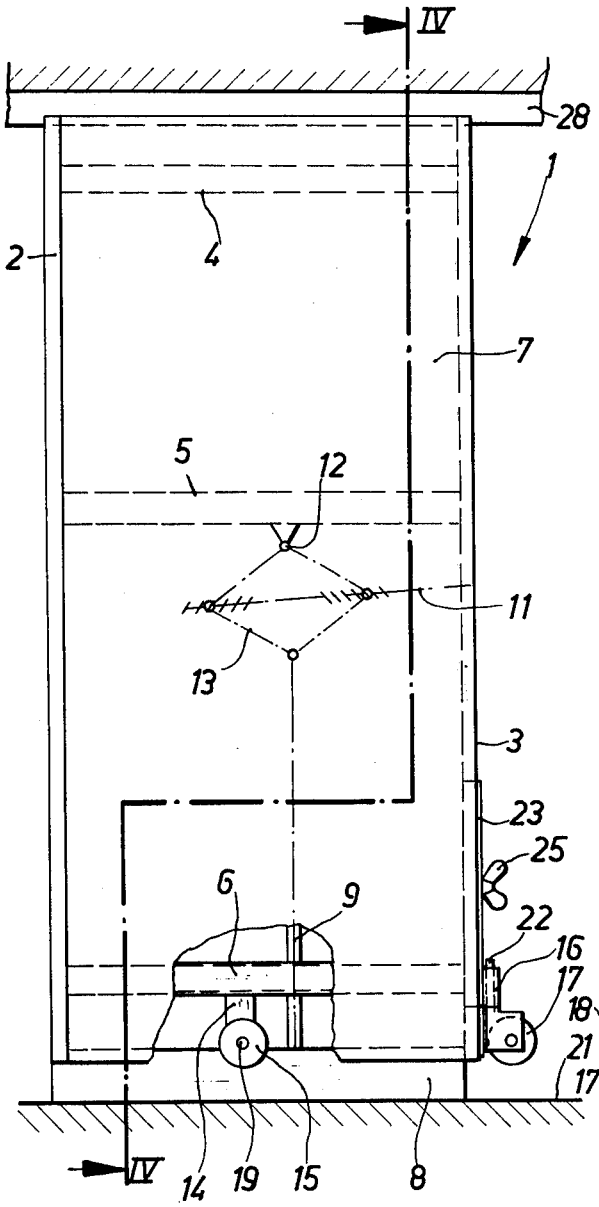
FIG. 3 is a side view corresponding to FIG. 1 in the braced state of the partition element.
Figure 4:
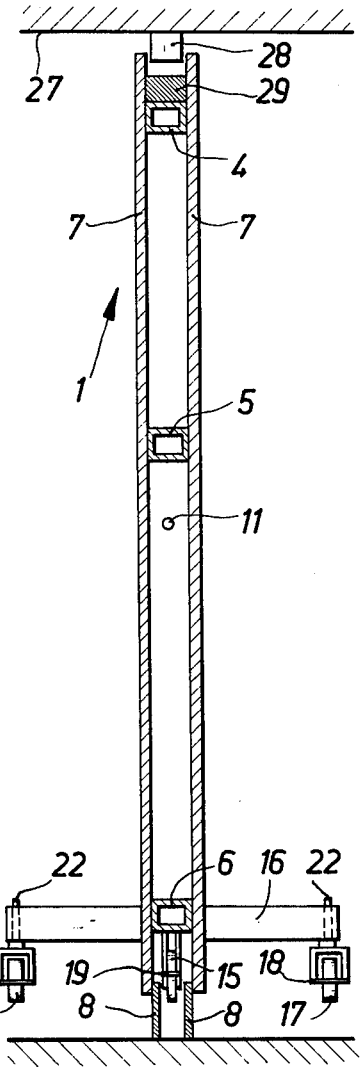
FIG. 4 is a cross-section corresponding to FIG. 2 along line IV—IV in FIG. 3.

If the wall element 1 is in the unbraced state shown in FIGS. 1 and 2, it can be moved about freely on the floor 21 with the help of the casters 15, 17; because of the swivelability of the casters 17 around the vertical pivots 22 it is extremely maneuverable and, on the other hand, there is no danger of tipping over one way or the other and being damaged. As soon as the element 1 is brought to the intended installation location and placed in position, by turning the spindle 11 (by means of the crank 10) the pushrod 9 and therewith the pressure strip with pressure bands 8 is forced downwards. As soon as the latter rest on the floor 21, the element, through further turning of the crank 10, is completely raised, causing the casters 15 and 17 to be released from the floor. Simultaneously the upper edge 26 of the element 1 approaches the ceiling 27 of the room. In the present execution example, there is attached to the latter a cleat 28 of such dimensions that the cover panels 7 of the raised wall element 1 enclose it on both sides, so that even without vertical pressure against the ceiling 27, the wall element 1, as a result of the form-locking on the upper edge 26 and of the frictional contact (as a result of the inherent weight of the element) in the area of the lower edge, is firmly installed. A sealing strip 29 can be inserted above the upper frame cross spar 4. This strip 29 can be shaped so that in the braced state of the wall element 1, as shown in FIGS. 3 and 4, it lies against the cleat 28 and prevents the formation of any sound passage.

In the braced state of the wall element 1 (FIGS. 3, 4) the carrier 16 with the vertical spar 23 can easily be loosened and removed from the frame stud 3, so that, in the case of a partition consisting of several elements it can be used for bringing up the next element. And in the opposite case, i.e., in dismantling the wall element, the same is true: in the still braced state of the wall element 1, the carrier 16 can easily be attached with the vertical spar 23 to the frame stud 3, since only after retraction of the pressure strips with the pressure bands 8 does the element drop and the weight come to rest on the carrier 16 with the casters 17.

The invention is claimed as follows:

1. A movable partition comprising: a vertical wall element, means mounting a caster at the bottom of said wall element for moving said wall element to and from operating position, a pressure strip at the bottom of said wall element, substantially the same length as said wall element and interfitting therewith to seal said wall element to a floor, and pressure means for acting between said wall element and said pressure strip independently of said caster and of said caster mounting means for extending said pressure strip downwards relative to said wall element against the floor and thereby raising said wall element to lift said caster from the floor and to raise the top of said wall element against the ceiling.

2. A partition as set forth in claim 1 and further including a detachable carrier having outwardly extending portions, casters mounted on said outwardly extending portions and coplanar with the first mentioned caster, and means detachably connecting said carrier to said wall element, said casters rising out of contact with the floor when said carrier is connected to said wall element and said wall element is raised.

3. A partition as set forth in claim 2 wherein the casters mounted on the extending portions have vertical pivots on which said casters swivel.

4. A partition as set forth in claim 2 wherein said carrier includes a vertical spar, and the means detachably securing said carrier to said wall element secures said vertical spar to the vertical edge of said wall element.

5. A partition as set forth in claim 4 wherein the spar and the edge to which it is attached are of complementary shape, and the securing means comprises a hook-like member extendible through an opening in said wall element edge, and means acting between said hook-like element and said spar for locking said hook-like element in place.

6. A partition as set forth in claim 1 wherein said wall element is a hollow wall element having a frame and cover panels on both faces thereof, said frame having a bottom cross spar on which the first mentioned caster is mounted.

7. A partition as set forth in claim 1 wherein the top edge of the wall element is relieved to embrace a cleat attached to the ceiling without exerting substantial force against the ceiling.

8. A partition as set forth in claim 7 and further including a sealing strip at the top of said wall element and attached to lie against said cleat with a wall element in raised position.

* * * * *